United States Patent [19]

Ebbing et al.

[11] Patent Number: 5,055,004

[45] Date of Patent: Oct. 8, 1991

[54] STROKE CONTROL ASSEMBLY FOR A VARIABLE DISPLACEMENT COMPRESSOR

[75] Inventors: David M. Ebbing, Clarence Center; Robert L. Swadner, E. Amherst; Jerome E. Puterbaugh, Getzville, all of N.Y.

[73] Assignee: General Motors Corporation, Detroit, Mich.

[21] Appl. No.: 527,628

[22] Filed: May 23, 1990

[51] Int. Cl.[5] ..... F04B 49/00

[52] U.S. Cl. ..... 417/222 R; 92/12.2

[58] Field of Search ..... 417/222, 222 S; 92/12.2

[56] References Cited

U.S. PATENT DOCUMENTS

| | | | |
|---|---|---|---|
| 3,067,595 | 12/1962 | Faure . | |
| 3,105,369 | 10/1963 | Mazziotti et al. . | |
| 3,218,827 | 11/1965 | Aucktor . | |
| 4,729,718 | 3/1988 | Ohta | 417/222 S |

FOREIGN PATENT DOCUMENTS

| | | | |
|---|---|---|---|
| 972819 | 3/1964 | United Kingdom . | |
| 1042721 | 12/1966 | United Kingdom . | |
| 2155115 | 9/1985 | United Kingdom | 417/222 S |

*Primary Examiner*—Robert G. Nilson

[57] ABSTRACT

An assembly for enhancing piston stroke control for a variable displacement wobble plate compressor having basic differential gas pressure control includes a non-rotary shaft mounted to provide translational axial movement in the housing of the compressor. A helical compression spring biases the shaft and non-rotary socket plate in an upstroke direction towards full piston stroke operation. The upstroking force provided by the spring acts to compliment the internal refrigerant gas pressure to provide for improved control and stability for piston stroking. The socket plate is driven to nutate by a journal pivotally mounted on a central drive hub. The control assembly further includes a set of ears with outer flats that mate with inner flats on cooperating flanges of the drive hub. Pivot pins extending perpendicular to the direction of piston travel connect the ears of the journal with the flanges of the drive hub. The flanges on the drive hub have kidney slots to assist in controlling the pivoting movement of the journal. The pivoting movement of the journal/socket plate assembly and the biasing action of the spring provides efficient upstroke and destroke control of the compressor pistons.

3 Claims, 2 Drawing Sheets

STROKE CONTROL ASSEMBLY FOR A VARIABLE DISPLACEMENT COMPRESSOR

TECHNICAL FIELD

The present invention relates generally to variable displacement compressors, and more particularly, to an improved assembly for controlling the stroke of the pistons in a variable displacement, wobble plate compressor.

BACKGROUND OF THE INVENTION

A popular type of refrigerant compressor for use in vehicle air conditioning systems involves a wobble or nutating drive mechanism to provide infinitely variable displacement. In this type of compressor, a plurality of cylinders are equally angularly spaced about a cylinder block and compressor housing, and equally radially spaced from the axis of a central drive hub. A piston is mounted for reciprocating motion in each of the cylinders. A piston rod connects each piston to a non-rotatable socket or wobble plate that provides the nutating motion in response to a rotating drive shaft attached to the central drive hub. The driving of the socket plate in a nutating path serves to impart the linear reciprocating motion to the pistons, thereby providing proper compressor operation. By varying the angle of the socket plate relative to the drive hub, in response to internal differential gas pressure, the stroke of the pistons and, therefore, the displacement or capacity of the compressor is varied.

A drive journal in the form of a disc and associated with the central drive hub is the rotating component that actually engages the socket plate. The journal is in substantially parallel driving relationship with the socket plate at all times, and thus the angle of both the socket plate and journal relative to the drive hub is substantially the same. Therefore, the stroke of the pistons, and accordingly the displacement or capacity of the compressor, is in effect a function of the angle of the journal.

Thus, as the journal rotates about its axis, the socket plate is held against rotation and is forced by the journal so as to travel in the nutating path. When the axes of the socket plate and journal are substantially coincident with the axis of the central drive hub, the compressor is operating at zero compression or zero stroke. Where the axes of the socket plate and journal are at their extreme allowable angle relative to the axis of the drive hub, the compressor is operating at full compression or full stroke. It can be appreciated that the stroke of the pistons is infinitely adjustable between zero stroke and full stroke as the socket plate and journal pivot from axial coincidence with the central drive hub to the extreme position.

As mentioned above, the angle of the socket plate/-journal assembly is basically a function of a difference in internal refrigerant gas pressures. More particularly, the differential between the internal housing or crankcase pressure and the suction pressure of the compressor determines the angle of the assembly, and accordingly the stroke or displacement of the compressor. While prior art compressors thus rely primarily on the net force created by the compressor housing-suction pressure differential to pivot the assembly, a split ring return spring is also provided simply to initiate a short-stroke movement from the zero stroke position towards the full stroke position.

In order for the socket plate/journal assembly to operate properly, the journal must pivot during operation about an axis defined by a pivot pin spaced from the central axis of the compressor, and extending substantially perpendicular to the direction of piston movement. During pivoting, the pivot pin moves along its supporting kidney slot in order to assist in maintaining alignment of the pistons within the mating cylinders. There is also provided in present socket plate compressors, a pivot pin/sleeve arrangement for guiding the journal's translational movement along the rotating central drive shaft. For a more complete review of this arrangement, reference is made to FIGS. 1 and 2 in U.S. Pat. No. 4,815,358 to Smith, issued Mar. 28, 1989, and owned by the present assignee.

While this prior art journal mounting arrangement is thus successful in directing the pivoting action of the journal, as determined by the differential gas pressure, it provides minimal true upstroke and destroke control. In this regard, it is now recognized that the relationship between differential refrigerant gas pressure and piston stroke is non-linear, and thus difficult to accurately control along the full range of movement. As referenced above, the split ring return spring in the prior art compressors tries to alleviate the problem but doesn't fully solve it, since its spring action is effective only for a very short distance on the upstroke, that is, at the start of the movement from the zero stroke position. Once this return spring becomes disengaged from the sleeve just after initiation of travel along the drive shaft towards the full stroke position, the ability to assist in providing control is, of course, lost.

Accordingly, there is a need for an improved assembly to provide stroke control along the full range of movement of the journal, as opposed to initiation and thus control, for only the very short distance at the start of the upstroke. If this can be accomplished, it would allow the compressor to upstroke and destroke more efficiently. Ideally, the improved control assembly would provide the proper complementary stroking force to coact with the housing-suction pressure differential to provide more efficient compressor operation. Such an assembly would thus improve stroke controllability by linearizing the relationship between the overall upstroking/destroking control force and the desired corresponding piston stroke. Furthermore, it would be desirable to integrate the stroke control assembly with the compressor torque restraint mechanism, such as disclosed and claimed in the copending Ebbing et al U.S. application entitled RZEPPA JOINT SOCKET PLATE TORQUE RESTRAINT ASSEMBLY FOR A VARIABLE DISPLACEMENT COMPRESSOR, filed Apr. 5, 1990, Ser. No. 07/504,817.

SUMMARY OF THE INVENTION

Accordingly, it is a primary object of the present invention to provide an improved assembly that allows an enhanced and more efficient control of the stroke of the pistons in a variable displacement compressor.

It is another object of the present invention to provide a control assembly for such a compressor that complements the differential pressure action and generates a controlled stroking force at all stroke positions of the pistons.

It is another object of the present invention to provide a control assembly that establishes a substantially linear relationship between the combined stroke control, including the internal refrigerant gas pressure, and compressor piston stroke.

Another object of the present invention is to provide a control assembly that generates improved pivoting movement of the rotating journal and associated non-rotary socket plate about an axis substantially perpendicular to the direction of piston movement to provide the proper upstroke and destroke for efficient compressor operation.

It is an additional object of the present invention to provide a control assembly generating improved pivoting movement of the journal and socket plate of the compressor with full integration and cooperation with the cooperating compressor torque restraint assembly.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved stroke control assembly for a variable displacement wobble plate compressor is provided. The stroke control assembly beneficially provides positive control through the full range of movement. The control action complements, and assists in stabilizing, the stroking force cooperating with the internal differential gas pressure to improve compressor operating efficiency. The pivoting action of the socket plate/journal assembly is also controlled and made more efficient during this upstroking and destroking of the pistons.

Compressor upstroke is defined as the action of increasing cylinder displacement or piston stroking towards full stroke operation and increased refrigerant pressure. Compressor destroke is defined as the action of decreasing cylinder displacement or piston stroking towards zero stroke operation. Destroke occurs as the air conditioning demand decreases, reducing the need for compressor capacity.

The stroke control assembly is advantageously integrated with the improved socket plate torque restraint assembly described in the co-pending Ebbing et al. patent application (see above). The disclosure of that application is incorporated herein by reference. As explained in detail therein, the extent of piston travel is positively controlled by the nutating action of the socket plate driven by the rotating journal or swash plate. The socket plate is held against rotation by its associated attachment to a centrally located anti-rotational or non-rotary shaft. The shaft is advantageously mounted to allow translational axial motion within the compressor housing, but to prevent rotational motion. More specifically, the anti-rotational shaft is supported by a needle bearing at its end adjacent the drive hub. The needle bearing is pressed into the drive hub. Thus, the hub freely rotates and the anti-rotational shaft axially moves relative to the hub.

According to an important aspect of the invention, the stroke control assembly includes a helical compression spring attached to the compressor valve plate adjacent the external side of the cylinder block, and biases the anti-rotational shaft away from the valve plate and towards the drive hub. The biasing action exerted on the shaft assists in controlling and stabilizing the pivotal adjusting motion of the attached socket plate/journal assembly over its full range of movement. More particularly, the translational or straight-line motion of the anti-rotation shaft directs the socket plate/journal assembly to pivot towards the full stroke orientation.

The biasing action exerts a supplemental force that constantly urges the socket plate and journal to a position for full compressor displacement. The force is advantageously thus in the direction tending to reinforce the differential pressure of the compressor, as the refrigerant gas is compressed.

Also, the biasing action tends to minimize the effects of slight control pressure variations, as well as reducing other outside forces, such as the gyroscopic effect at high compressor speeds. The compressor is thus no longer speed sensitive since the spring action offsets these forces eliminating them as a significant factor. To offset the spring force for destroking, the design operating or set point suction pressure is moderately increased.

The upstroking force transmitted to the socket plate by the spring thus complements and cooperates with the force associated with the internal differential gas pressure. The resulting cooperation between the spring biasing action and the gas pressure differential establishes a linear relationship between the combined control action and piston stroke, thus advantageously improving stroke controllability.

The mounting or attachment between the journal on the drive hub allows limited pivoting movement; that is movement restricted to being about a single axis substantially perpendicular to the direction of piston motion. The particular manner in which this is done forms another part of the control assembly of the present invention. More specifically, the drive hub is formed with a pair of integral flanges having inward facing flat surfaces or flats. The journal is formed with a pair of ears that have outer facing flat surfaces of flats. When nested together and assembled, the outer flats of the journal ears cooperatively mate with the inner flats of the hub flanges so that lateral guiding movement between them is provided.

Each flange is formed with a kidney slot that receives an associated drive pin for a limited range of travel. Each drive pin is press fit into a hole formed in each journal ear: the drive pins thus acting to secure the journal to the drive hub. The drive pins act as captive cam followers through limited travel along the cam surface of the kidney slots, further assisting the advantageous pivoting movement of the journal.

More particularly, the pin/slot engagement allows the socket plate/journal assembly to maintain substantially the same radially centered and non-skewed position relative to the compressor housing at all stroke positions. This positioning is further assisted by the unique attachment of the socket plate to the anti-rotational shaft, as described in the co-pending Ebbing et al. application. Therefore there is substantially constant radial clearance between both the housing and the anti-rotational shaft, and the plate/journal assembly. As a result, the piston rods substantially maintain the proper straight driving action during both upstroking and destroking reducing stress and increasing the overall compressor efficiency.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of &:he invention, an example of which is illustrated in the accompanying drawing.

DETAILED DESCRIPTION OF THE INVENTION

Figure 1:
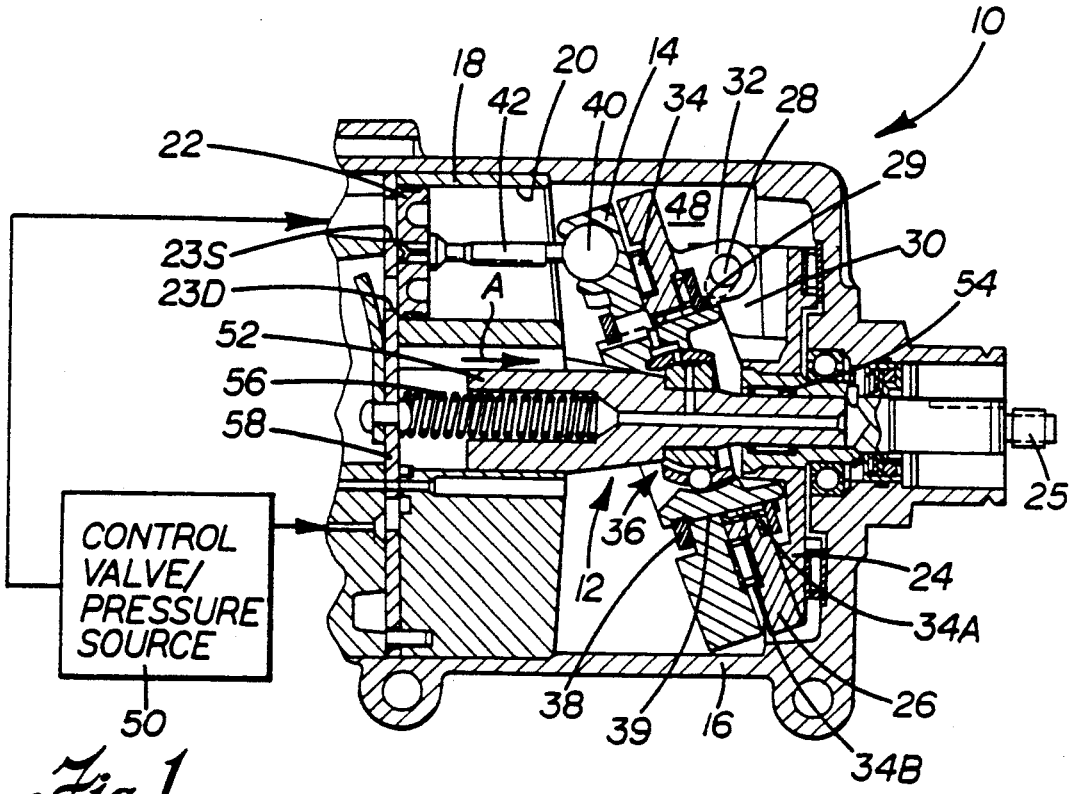
FIG. 1 is a partial cross-sectional view of the variable displacement socket plate compressor including the improved stroke control assembly of the present invention, shown in the full stroke position.
Figure 2:
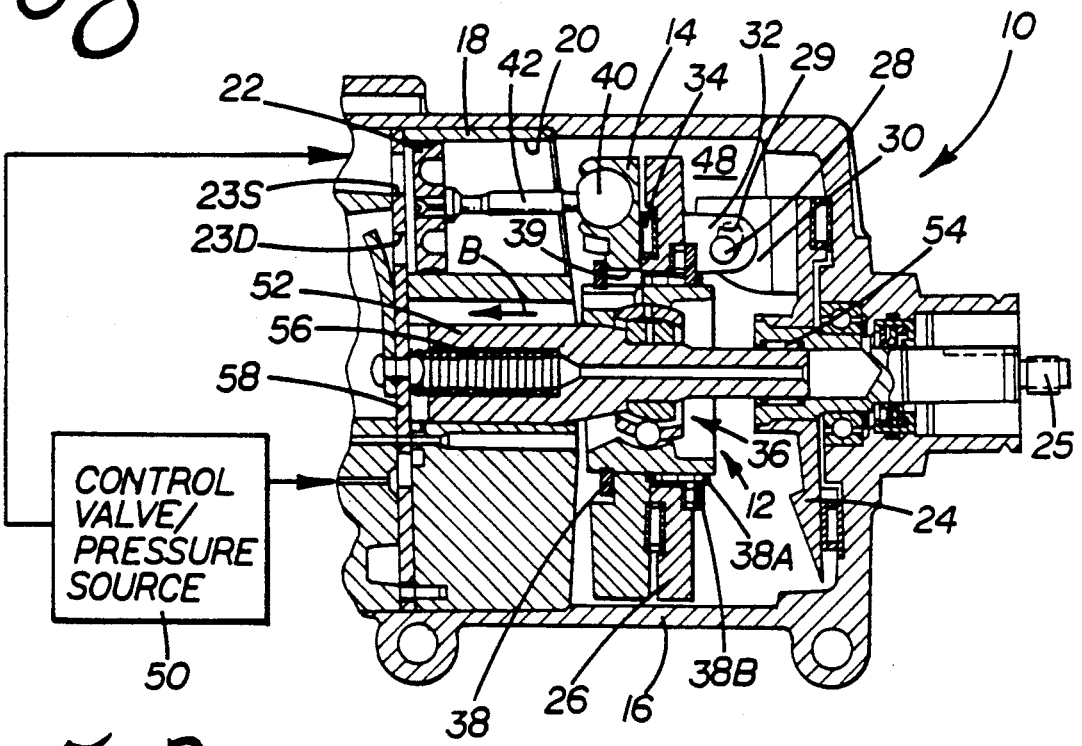
FIG. 2 is a partial cross-sectional view similar to FIG. 1 but showing the compressor in zero stroke position.

Reference is made to the drawing and in particular to FIGS. 1 and 2 wherein is shown a variable displacement socket plate compressor 10 including an improved piston stroke control assembly integrated with a socket plate torque restraint assembly 12. The restraint assembly 12 transmits torque from the socket plate 14 to the crankcase or compressor housing 16, as is particularly disclosed and described in the above-referenced copending Ebbing et al. application. The compressor 10 includes a cylinder block 18 having a plurality of cylinder bores 20 (only one shown in FIGS. 1 and 2). The preferred embodiment of the present invention is contemplated for use with a refrigerant compressor having seven cylinder bores 20. However, it can be appreciated the refrigerant compressors can be designed with a fewer or greater number of cylinder bores 20.

A piston 22 is slidingly engaged for reciprocable motion within each of the cylinder bores 20. The composite reciprocating action of the pistons 22 compresses the refrigerant. The compressed refrigerant passes through discharge ports 23D of the compressor 10, and after further processing, is utilized by the air conditioning system of the vehicle (not shown) to condition or cool air being directed to the vehicle interior. The refrigerant is returned to the compressor 10 through a suction port 23S to complete the cycle.

A drive hub 24 is axially aligned with the cylinder block 18 at the opposite end of the compressor housing 16. The drive shaft 25 of the hub 24 extends externally of the compressor housing 16 to engage the driving pulley of an automobile engine (not shown). During engine operation, power is transmitted from the engine to the drive shaft 25 and thence to the drive hub 24.

Figure 3:
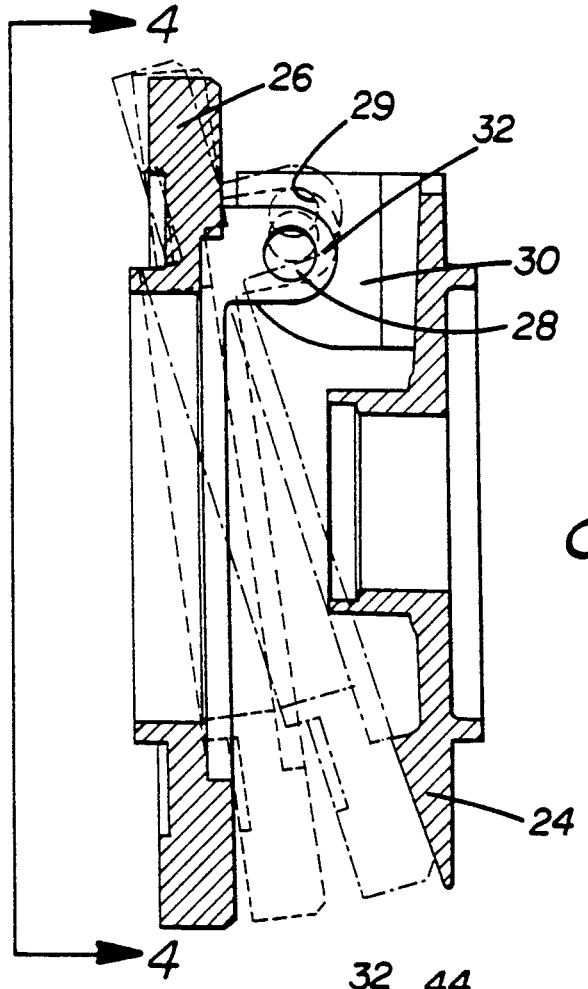
FIG. 3 is a cross-sectional view of the drive hub/-journal mounting arrangement showing the pivoting movement of the journal with respect to the drive hub from the zero stroke full line position towards the full stroke position so as to maintain the radially centered position, shown progressively in phantom.

A journal or swash plate 26 is positioned to provide the actual driving action to reciprocate the pistons 22. For this purpose, the journal 26 actually mounts on the drive hub 24 with a pair of spaced, pivotal drive pins 28 received within spaced kidney slots 29 (see FIG. 3) formed on flanges 30. The drive pins 28 are press fit into holes in a corresponding set of journal ears 32. This arrangement forms a portion of the stroke control assembly of the present invention, and will be described in further detail below. At present, suffice it to say that this pivotal mounting of the journal 26 on the drive hub 24 causes the journal 26 to rotate with the drive hub. The socket plate 14 is in juxtaposition and nutates with the journal 26, but does not rotate. A needle drive bearing 34 is mounted in between. A combination of two thrust needle bearings 34 and 34A and a radial needle bearing 34B secures the journal 26 to the wobble assembly formed by the socket plate 14 and a Rzeppa joint 36. This combination also allows relative rotation of the journal 26.

As mentioned above, the socket plate 14 is held against rotation by its connection to the restraint assembly 12 including Rzeppa joint 36 (used for socket plate torque restraint and radial support of the socket plate 14/journal 26 assembly only). A snap ring 38 and keyway/press fit 39 and a second snap ring 38A and a thrust washer 38B provide for thrust loading of bearing 34 and locks the assembly together.

In operation, as the drive hub 24 is driven, the journal 26 is rotated. This in turn imparts the nutating motion to the non-rotary socket plate 14. The pistons 22 are each connected to the socket plate 14 by a ball 40 and a piston rod 42. The angle of the journal 26 relative to the drive hub 24 can be varied or adjusted, thus determining the precise path traveled by the socket plate 14. More specifically, when the journal 26 is positioned at a substantially maximum angle as shown in FIG. 1, the nutating motion of the socket plate 14 is at a maximum. Thus, in this position, it should be appreciated that the pistons 24 are reciprocated through their full stroke. As a result, the compressor 10 operates at maximum capacity.

Conversely, when the journal 26 is adjusted so as to be substantially perpendicular to the drive hub, as shown in FIG. 2, the journal 26 spins without nutating or wobbling. The pistons 22 do not reciprocate in this operative situation. Thus, the operation of the compressor 10 to compress refrigerant is effectively terminated in this position. It can be appreciated that by infinitely varying the angle of the journal 26 anywhere between these two extremes, the operation of the compressor 10 at an infinite number of intermediate capacity levels may be achieved, as desired.

The most efficient upstroking and destroking of the compressor 10 requires that the pivoting arrangement of the journal 26 on the drive pins 26 to be about an axis maintained and held stable so as to be perpendicular to the direction of motion of the pistons 22, as referred to above. The backpressure of the socket plate 14 against the rotating journal face forces the journal 26 to pivot on the spaced drive pins 28. The pivoting action of the journal 26 as it follows the drive hub 24 between the zero stroke position and the full stroke position, is particularly shown in FIG. 3. Zero stroke is indicated by the full line position and full stroke is indicated by the extreme angled phantom line position.

Figure 4:
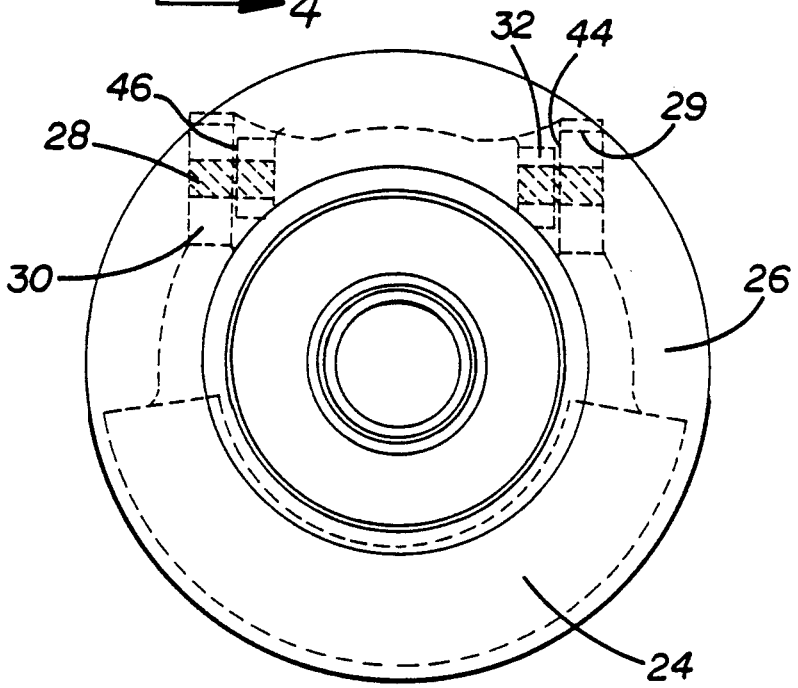
FIG. 4 is an end view of the drive hub/journal assembly looking in the direction of arrows 4—4 in FIG. 3.

As best shown in FIG. 4, the flanges 30 of the drive hub 24 have inner facing flats 44. The journal ears 32 have outer facing flats 46. When nested together and assembled, the inner flats 44 of the flanges 30 and the outer flats 46 of the ears 32 are in lateral guiding relationship, and thus cooperatively mate together to stabilize the journal pivoting action. Thus, the pivoting or swinging motion of the journal 26 with respect to the drive hub 24 (shown in FIG. 3) is limited or restricted, and thus desirably stabilized and controlled. More particularly, the relative pivoting motion of the journal 26 is efficiently guided by the mating flanges 30/ears 32 on the spaced drive pins 28. The pivoting action is limited to movement about the single axis and in the same direction as the piston movement during stroke operation. The spacing of the drive pins 28 and the mating of the flats 44, 46 prevent skewing of the journal 26 about any other axis. The driving engagement with the socket plate 14 is very stable, and thus free of binding action, as could sometimes be a problem with single pin/trunion mounting arrangements of the prior art. This restricted pivoting action also advantageously assists in maintaining the accurate positioning of the piston rods 42, so as to be centered in their respective cylinder bores 20 at all times. The friction is substantially reduced in both the journal/socket plate assembly and along the pistons, further adding to the efficiency of the compressor 10.

The spaced kidney slots 29 are an important part of the stroke control assembly in a similar manner in that the drive pins 28 are controlled by a limited range of motion therein. This controlled movement aids in compressor efficiency by allowing the journal 26 to seek a radially centered position (as viewed in FIG. 3) to further assist in guiding and centering the pistons 22. This action is also assisted by the radial needle bearing 34B between the journal 26 and outer race of the Rzeppa joint 36, which provides the required radial location of the journal 26 as it angulates from full displacement position to zero displacement position. The cam guiding action is stabilized between the spaced slots 29 and the pins 28.

In effect, these related features provide radially centered stability of the socket plate 14/journal 26 assembly during pivoting to the desired stroke orientation. In the full stroke position (FIG. 1 and extreme phantom line position in FIG. 3), the pins 28 are at the top of slots 29. In the zero stroke position (FIG. 2 and full line position in FIG. 3), the pins 28 are at the bottom of the slots 29. The shape of the slots 29 is determined by the geometry of the mechanism to provide minimal piston head clearance without interference of the piston head 22 at top dead center. Accordingly, the socket plate 14/journal 26 assembly pivots without skewing side-to-side and while maintaining the radially centered position; that is centered relative to the compressor housing 16, the cylinder block 18, the bores 20 and thus the pistons 22 at all stroke positions.

The radially centered stability of the assembly (again reference to FIG. 3) is further assisted by the design of the ball grooves in the Rzeppa joint 36, allowing the socket plate 14 to cooperatively travel with the journal 26. Thus, the proper alignment of the plate 14/journal 26 assembly is further assured by this integration of the two designs.

The piston rods 42 respond to the features of the control assembly with a substantially straight and radially centered driving action. Accordingly, it can be appreciated that these concepts provide not only improved pivoting action of the journal 26 minimizing stress exerted at the driving interface with the socket plate 14, but also by directing the pistons 22 in the desired straight paths with minimal skewing in the respective bores 20.

As set forth above, the angle of the socket plate 14/journal 26 assembly results primarily from controlling the differential refrigerant gas pressure; i.e. the angle and thus the piston strokes vary in accordance with the relationship between the suction pressure and the pressure in the interior 48 of the compressor housing 16. More particularly, compressor 10 operation is based on the relationship between the pre-set suction pressure that acts on the front face of the pistons 22 during the suction phase, and the controlled gas pressure in the housing interior 48 acting on the back face of the pistons 22. In full pre-set operation with minimum housing pressure, the net or differential force exerted on the pistons 22 is such as to provide full piston stroke, and thus full compressor capacity. When the pressure acting on the rear face of the pistons 22 in the housing is increased, to disturb the pre-set equilibrium, the net force on the pistons 22 changes so as to reduce the angle of the socket plate 14/journal 26 assembly. This reduces the stroke of the pistons 22 and thus the capacity of the compressor 10. This differential pressure control is provided by a control valve/pressure source, denoted schematically in FIGS. 1 and 2 as numeral 50. The additional factors efficiently complementing this compressor upstroking/destroking control action will be discussed in detail below.

Anti-rotational shaft 52 is coaxially mounted with respect to the drive hub 24 to allow for translational axial motion. The needle bearing 54 pressed into the rotary drive hub 24 allows the hub to rotate around the shaft 52 without imparting rotary motion thereto. The needle bearing 56 also allows the shaft 52 to slide translationally within the hub 24. The non-rotary feature of the shaft 52 assists in the torque restraint function of the assembly 12, as particularly described and claimed in the above-compressor mentioned co-pending Ebbing et al. application.

The translational capability, of the shaft 52 along its axis aids in the upstroking and destroking of the compressor 10. The socket plate 14 cooperates with the shaft 52 through the Rzeppa joint 36. As the shaft 52 axially translates, the configuration of the Rzeppa joint 36 changes. This action influences the socket plate 14 and journal 26 to pivot, changing the angle of the socket plate 14, and accordingly the stroke of the pistons 22.

In accordance with an important aspect of the present invention, compression spring 56 attached to a compressor valve plate 58 acts to bias the shaft 52 away from the cylinder block 18 and towards the drive hub 24. This is particularly shown by force action arrow A in FIG. 1, with the spring 58 being extended toward the full stroke position. The compression spring 56 exerts the force urging the shaft 52 towards the full compression mode along the full range of movement. Through the Rzeppa joint 36 attachment to the shaft 52, the orientation of the socket plate 14/journal 26 assembly is thus affected by the biasing action imparted by the spring 56. More particularly, the assembly is influenced to pivot in response to this translation. To put it another way, as spring 56 urges the shaft 52 away from the valve plate 58, the socket plate 14/journal 26 assembly is urged towards the full stroke position.

It has been discovered that the differential gas pressure is in fact non-linear with respect to the ideal stroke of the pistons 22. In the preferred embodiment shown, this additional biasing force is thus needed and desirable to more efficiently upstroke or move the shaft 52 toward the drive hub 24, and thus the pistons 22 toward the full stroke position (note the force arrow A again in FIG. 1). On this upstroke, it will be remembered the journal 26 pivots to its full stroke position of FIG. 1 guided by the pins 28 in the slots 29 and the Rzeppa joint 36. The spring 56 forming a key element of this control assembly allows this action to be ideally accomplished by complementing the differential gas pressure force, and being effective along the full range of movement of the journal 26. As the control valve/pressure source 50 calls for a capacity increase, the stroke increases due to the differential pressure change and the biasing force of the spring 56 advantageously serves to ideally complement, or work in concert with this pressure change.

The spring constant of the spring 56 is selected to provide the biasing factor needed to best complement the differential gas pressure and establish a linear relationship with respect to the ideal piston stroke. Although only a single spring 56 is shown, multiple, such as dual, concentric springs, or a variable constant spring, may be used to vary the spring force, and thus match the biasing force along the adjustable range of the piston stroke as needed. The spring force also coacts with the head pressure of the compressor, providing both an additional upstroking force and further balance around the entire compressor. Especially at high speeds, the spring 56 tends to stabilize the operation of the compressor 10, and also serves to offset outside (including gyroscopic) forces.

Just as the spring 56 expands and thus assists in control of the upstroking, it resists and likewise assists in linearizing the destroking action. The differential gas pressure provides the destroking and compresses the spring 56 to the position of FIG. 2 (see Action Arrow B). With the added force of the spring 56, for upstroking, the pressure in the housing 16 may be moderately increased and/or the suction pressure decreased for destroking. As a composite action, not only is the overall linear relationship obtained, but improved stability is gained through adding the supplemental force of the spring 56 to the other counterbalancing forces along the full range of adjustment.

During stroking in either direction, the pivot pins 28 moving along the slots 29, and the nesting engagement of the flats 44, 46, work in concert with the spring action just described providing a control assembly ideally suited for the variable displacement compressor 10. Furthermore, the Rzeppa joint 36 is fully integrated with the control assembly to provide full cooperation and further assure controlled and highly efficient stroking action.

In summary, numerous benefits are obtained by the use of the improvements of the present invention. The anti-rotational shaft 52 mounted for translational axial motion is mechanically biased towards the drive hub 24 by the helical compression spring 56. This arrangement forms a key component of the control assembly of the invention. The added biasing provides a controlled stroking and stabilizing force for the compressor pistons 22 at all stroke positions. There is established a linear relationship of the combined action of the internal refrigerant gas pressure differential and the spring biasing action with respect to the piston stroking along the full range of adjustment.

The stroke control assembly also includes the novel mounting of the journal 26 with the spaced ears 32 that cooperatively mate with the spaced flanges 30 on the rotating drive hub 24. This mounting advantageously directs and limits the pivoting movement about a single axis substantially perpendicular to the direction of motion of the pistons 22. This arrangement along with the pivot action of the spaced drive pins 28 in the kidney slots 29 establishes controlled pivoting action with no skewing, and thus maintains the proper radially centered positioning of the journal 26. The control of both the upstroke and destroke operation and the movement of the pistons 22 is enhanced.

The foregoing description of a preferred embodiment of the invention has been presented for purposes of illustration or description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. An assembly for providing piston stroke control for a variable displacement compressor having a housing, a non-rotary shaft and socket plate mounted thereon, and a rotatable drive hub/journal assembly for driving said socket plate to nutate and drive pistons within cylinders mounted in the housing, comprising:

means for mounting said shaft to provide for translational motion in said housing, the relative axial position of said shaft being associated with the extent of compressor displacement;

spring means for axially biasing said shaft so as to urge said socket plate towards full stroke operation along the full range of movement; and means for pivotally mounting said journal on said drive hub to allow controlled pivoting movement of said journal relative to said drive hub, said mounting means including spaced drive shafts on said drive hub/journal assembly extending along a single axis perpendicular to the direction of piston movement;

spaced kidney slots on said drive hub/journal assembly for receiving and guiding said shafts so as to be radially centered during pivoting movement of said journal;

whereby enhanced piston stroke control is effected.

2. An assembly for providing piston stroke control for a variable displacement compressor having a housing, a non-rotary shaft and socket plate mounted thereon, and a rotatable drive hub/journal assembly for driving said socket plate to nutate and drive pistons within cylinders mounted in the housing, comprising:

means for mounting said shaft to provide for translational motion in said housing, the relative axial position of said shaft being associated with the extent of compressor displacement;

a helical compression spring for axially biasing said shaft so as to provide a controlled stroking force to urge said socket plate towards full stroke operation;

at least two spaced mounting ears integral with said journal;

at least two spaced flanges integral with said device hub;

said ears and said flanges having mating and nesting flats to cooperatively direct pivoting movement of said journal without skewing;

spaced pin means for pivotally mounting said ears on said flanges; and said flanges each including a kidney slot for receiving the respective said pin means for allowing controlled pivoting action of said journal on said drive hub, said pin means having a limited range of motion within said kidney slots to assist said pivoting movement, whereby enhanced piston stroke control is effected.

3. An assembly as set forth in claim 2 wherein said pin means extend along a single axis perpendicular to the direction of piston movement.

* * * * *